US005800275A

United States Patent [19]

Gretzky et al.

[11] Patent Number: 5,800,275

[45] Date of Patent: Sep. 1, 1998

[54] CONVERTIBLE BOWLING LANE

[75] Inventors: Anthony J. Gretzky, Muskegon; Michael F. Stirling, Spring Lake, both of Mich.

[73] Assignee: Brunswick Bowling & Billiards, Muskegon, Mich.

[21] Appl. No.: 7,667

[22] Filed: Jan. 22, 1993

Related U.S. Application Data

[63] Continuation-in-part of Ser. No. 902,937, Jun. 23, 1992, Pat. No. 5,564,986.

[51] Int. Cl.[6] ..... A63D 5/00

[52] U.S. Cl. ..... 473/113; 473/55

[58] Field of Search ..... 273/37, 51, 51 R; 473/113, 115, 106, 110, 54, 55

[56] References Cited

U.S. PATENT DOCUMENTS 3,401,933 9/1968 Conklin et al. ..... 273/51

4,330,122 5/1982 Sheinberg et al. ..... 273/51

*Primary Examiner*—William M. Pierce

*Attorney, Agent, or Firm*—Wood, Phillips, VanSanten, Clark & Mortimer

[57] ABSTRACT

An improved method of using a convertible bowling lane including at least one movably mounted gutter (26) extending along a side (12,14) of a bowling lane bed (10) from the approach (18) toward the pin deck (16) thereof and mounting a ball deflecting rail (32) along the side (12,14) for movement between a first position wherein a ball moving toward the side (12,14) will engage the rail (32) before leaving the bed (10) and a second position wherein a ball moving toward the side (12,14) may leave the bed (10) to enter the gutter (26) and a curtain (100) installed to extend between the side (12,14) and the gutter (26) and to be exposed when the rail (32) is in the first position and covered by the gutter (26) when the rail is in the second position. The method includes the steps of making the curtain (100) in at least two sections (112,114,116) including at least one relatively short, easily removable section (112,116) adjacent the approach (18) and placing indicia (118,120) on the short section (112,116) to be exposed to the user of the lane when the rail (32) is in the first position.

10 Claims, 3 Drawing Sheets

CONVERTIBLE BOWLING LANE

CROSS-REFERENCE

This application is a continuation-in-part of commonly assigned application Ser. No. 902,937, filed Jun. 23, 1992 U.S. Pat. No. 5,564,986 and entitled "Convertible Bowling Lane".

FIELD OF THE INVENTION

This invention relates to a bowling lane that is convertible between a configuration for conventional bowling and a configuration wherein balls are prevented from entering the gutters for use as a carom bowling lane or for use in instruction of beginners, etc.

BACKGROUND OF THE INVENTION

Over the years, there have been a number of proposals for convertible bowling lanes. One such proposal is in commonly assigned U.S. Pat. No. 3,401,933 issued Sep. 17, 1968 to Conklin et al., the details of which are herein incorporated by reference. The Conklin et al. patent discloses a construction wherein the gutters along the sides of a lane bed are mounted for movement between raised and lowered positions. In the lowered position, the concave surface of the gutter faces upward as with a conventional gutter and is able to freely receive a ball leaving the lane bed.

In the raised position, each gutter exposes an elongated rail or bumper which faces the lane bed. A ball moving toward the side of the lane bed is prevented from leaving the lane bed by reason of the location of the rail in proximity to the lane bed. That is to say, the ball will strike the rail before it can leave the lane bed.

In this way, the ball is essentially restrained on the lane bed and may carom from one side to the other along the substantial majority of the length of the bed.

A curtain interconnects the side of the lane bed and the gutter just below the rail thereon. This curtain obscures that part of the lane construction underneath the gutter as well as the underside of the gutter itself. It also acts as a stop to limit movement of the gutter as it is moved towards its raised position.

A motor driven winch system is provided for raising or lowering the gutter. Elongated cables are reeved about sheaves pivoted to levers which, in turn, are affixed to the gutter at a plurality of locations along the length thereof. By pulling in on the cable, the gutters may be moved to their raised position for carom bowling while by paying out cable, the gutters may be lowered to their conventional bowling position.

In addition, an elongated tape switch is associated with the rail for the purpose of detecting ball-rail contact and alerting the user of the lane to that fact.

As can be readily appreciated, the Conklin et al. system is somewhat complex in terms of both the provision for means for raising and lowering the gutters between their two operative positions and in terms of providing some means of detecting ball-rail contact. In many instances, the degree of sophistication in the Conklin et al. system is not required. By way of example, the Conklin et al. system is useful in instructing novice bowlers.

While learning the game of conventional bowling, it is not unusual for novices to throw many "gutter" balls which is to say, balls which leave the lane bed before they travel to the pin deck to down pins thereon. Particularly with younger bowlers, the throwing of an inordinate number of gutter balls can be very discouraging; and by use of the Conklin et al. lane configured for carom bowling, that occurrence can be prevented. As a consequence, instruction of novice bowlers is made easier.

At the same time, there is no need in such an instructional situation for any means for detecting ballrail contact.

Furthermore, where novices are bowling simultaneously with more experienced bowlers who do not require the presence of the rails for preventing the throwing of gutter balls, the Conklin et al. winch system may be considered by some to be somewhat slow in shifting the gutters between conventional bowling and carom bowling positions. Since bowling is normally paid for by the "line" or "game", any slowing down of playing a game can adversely affect the proprietors income. Consequently, there is a need for a convertible bowling lane that can be rapidly converted between conventional bowling and carom bowling positions.

Moreover, the field of recreational activity is becoming increasingly competitive. Bowling is no exception. Consequently, bowling lane proprietors are continually seeking new ways to tap new sources of revenue through use of their bowling facilities, with little or no modification.

The present invention is directed to overcoming one or more of the above problems.

SUMMARY OF THE INVENTION

It is the principal object of the invention to provide a new and improved convertible bowling lane. More specifically, it is an object of the invention to provide such a convertible bowling lane that may be readily converted between two different bowling configurations and which is simple to install, maintain and operate.

An exemplary embodiment of the invention achieves the foregoing in a convertible bowling lane including a bowling lane bed with at least one gutter extending along the side of the bed and including ball catching means and ball deflecting means. Means are provided for movably mounting the gutter for movement between a ball catching position for catching a ball leaving the bed along the side and a ball deflecting position for deflecting a ball approaching the side. The convertible bowling lane includes manual means for moving the gutter between the two positions.

In a preferred embodiment, a detent means is provided for holding the gutter in either of these two positions.

In a highly preferred embodiment, the detent means includes an overcenter mechanism.

Preferably, the overcenter mechanism includes a pair of stops. One stop limits movement of the gutter past the ball catching position and the other stop limits moving of the gutter past the ball deflecting position. A spring interconnects and biases the gutter relative to a stationary object and is arranged to exert a lesser bias on the gutter when the gutter is in either of the two positions, and a greater bias on the gutter when the gutter is between the positions. Typically, the spring is a conventional compression coil spring.

The invention contemplates that the gutter be mounted for pivotal movement between the positions about an axis. Further included is a lever mounted to the gutter for movement therewith between the positions on opposite sides of the axis as the gutter moves between the ball catching and ball deflecting positions, and the spring is connected to the lever.

In a highly preferred embodiment, a torque tube mounts the gutter generally along an edge thereof. The lever is fastened to the torque tube and a plurality of channels are disposed of along the lane. The torque tube is nested in the channels for pivotal movement therein and the spring further acts to bias the torque tube into the channels. As a consequence of this construction, installation of the convertible lane is simplified.

Another principal object of the invention is to provide a new and improved convertible bowling lane which provides a means of enhancing revenue obtainable out of bowling lane operations. More specifically, it is the principal object of the invention to provide, in a convertible bowling lane, a means of obtaining advertising revenue.

According to this object of the invention, there is contemplated a method of using a convertible bowling lane of the type having at least one movably mounted gutter extending along the side of a bowling lane bed from the approach toward the pin deck thereof. The gutter mounts a ball deflecting rail along the lane side for movement between a first position wherein a ball moving toward the side will engage the rail before leaving the bed and a second position wherein a ball moving toward the side may leave the bed to enter the gutter. A curtain is installed to extend between the side and the gutter and is exposed when the rail is in the first position and is covered by the gutter when the rail is in the second position. The method includes the steps of making the curtain in at least two sections including at least one relatively short section that is easily removable and which is located adjacent the approach and placing indicia on the short section(s) to be exposed to the user(s) of the lane when the rail is in the first position.

In a preferred embodiment of the invention, the indicia is advertising so that the short section(s) is useful as a readily changeable advertising medium.

According to still another facet of the invention, there is provided a curtain for use in a convertible bowling lane to be disposed between the side of a lane bed and the under side of a moveable gutter. The curtain includes at least two curtain panels of flexible material. One of the panels is relatively short relative to the other. Generally circular loops are disposed at the sides of the curtain panels and indicia is disposed on the relatively short one of the two curtain panels.

In a preferred embodiment, the indicia is advertising indicia.

The invention also contemplates that means be disposed within the loops to form and maintain the loops in a generally circular shape.

According to still another facet of the invention, there is provided a curtain for use in a convertible bowling lane to be removably disposed between the side of a lane bed and the underside of a moveable gutter at a location closely adjacent the approach of the bowling lane. The curtain includes a relatively short curtain panel of flexible material of a length considerably less than half the length of the bowling lane. It is provided with generally circular loops at its sides and indicia is disposed on the panel.

According to still another facet of the invention, there is provided a convertible bowling lane which includes at least one movably mounted gutter extending along the side of a bowling lane from the approach to the pin deck of the lane and which mounts a ball deflecting rail along the side for movement between a first position wherein a ball moving toward the side will engage the rail before leaving the bed and a second position wherein a ball moving toward the side may leave the bed to enter the gutter. A curtain is installed to extend between the side and the gutter and to be exposed when the rail is in the first position and covered by the gutter when the rail is in the second position. The curtain is defined by at least one relatively short, removable panel adjacent the approach and a separate, relatively long panel extending from the relatively short panel to the pin deck. Indicia is located on the relatively short panel.

Preferably, the relatively short panel may be removed from the bowling lane independently of the relatively long panel.

Other objects and advantages will become apparent from the following specification taken into connection with the accompanying drawings.

DESCRIPTION OF THE PREFERRED EMBODIMENT

Figure 1:
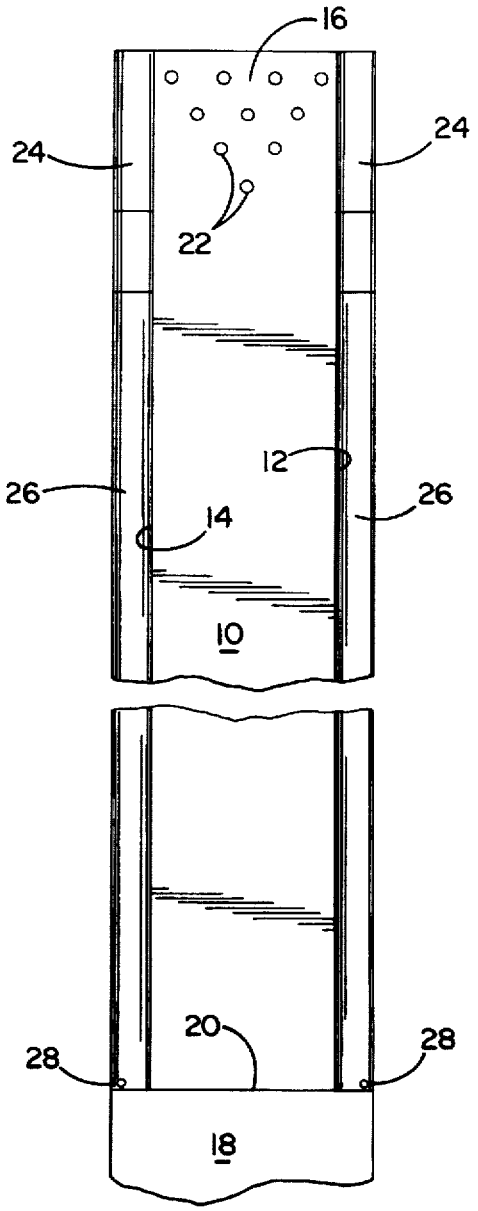
FIG. 1 is a plan view of a convertible bowling lane made according to the invention.

An exemplary embodiment of a bowling lane made according to the invention is illustrated in FIG. 1 and is seen to include a lane bed, generally designated 10. The lane bed 10 includes opposite sides 12 and 14 as well as a pin deck 16, and an approach area 18. As is well known, a foul line 20 is disposed between the approach 18 and the remainder of the lane bed 10 while pin spots 22 are located at the pin deck 16.

Flanking the pin deck 16 on both the sides 12 and 14 are conventional gutter sections 24 of relatively short length. Extending between the gutter sections 24 and the foul line 20 are movable, one piece convertible gutter sections 26. While FIG. 1 illustrates the convertible gutter sections 26 as extending to the foul line 20, it is contemplated that they may stop a short distance short of the foul line 20, if desired.

At their ends adjacent to foul line 20, the convertible gutter sections 26 each include a hole 28 for receipt of a handled tool to be described hereinafter. A tool is inserted in the hole 28 and manually moved to move the gutter sections 26 between the positions thereof as will be described.

It is to be understood that the gutter sections 26 associated with the sides 12 and 14 are mirror images of one another. Therefore, in the interest of brevity, only the gutter section 26 associated with the side 12 of the lane bed 10 will be described in view of the mirror image identity of the other gutter section 26.

Figure 2:
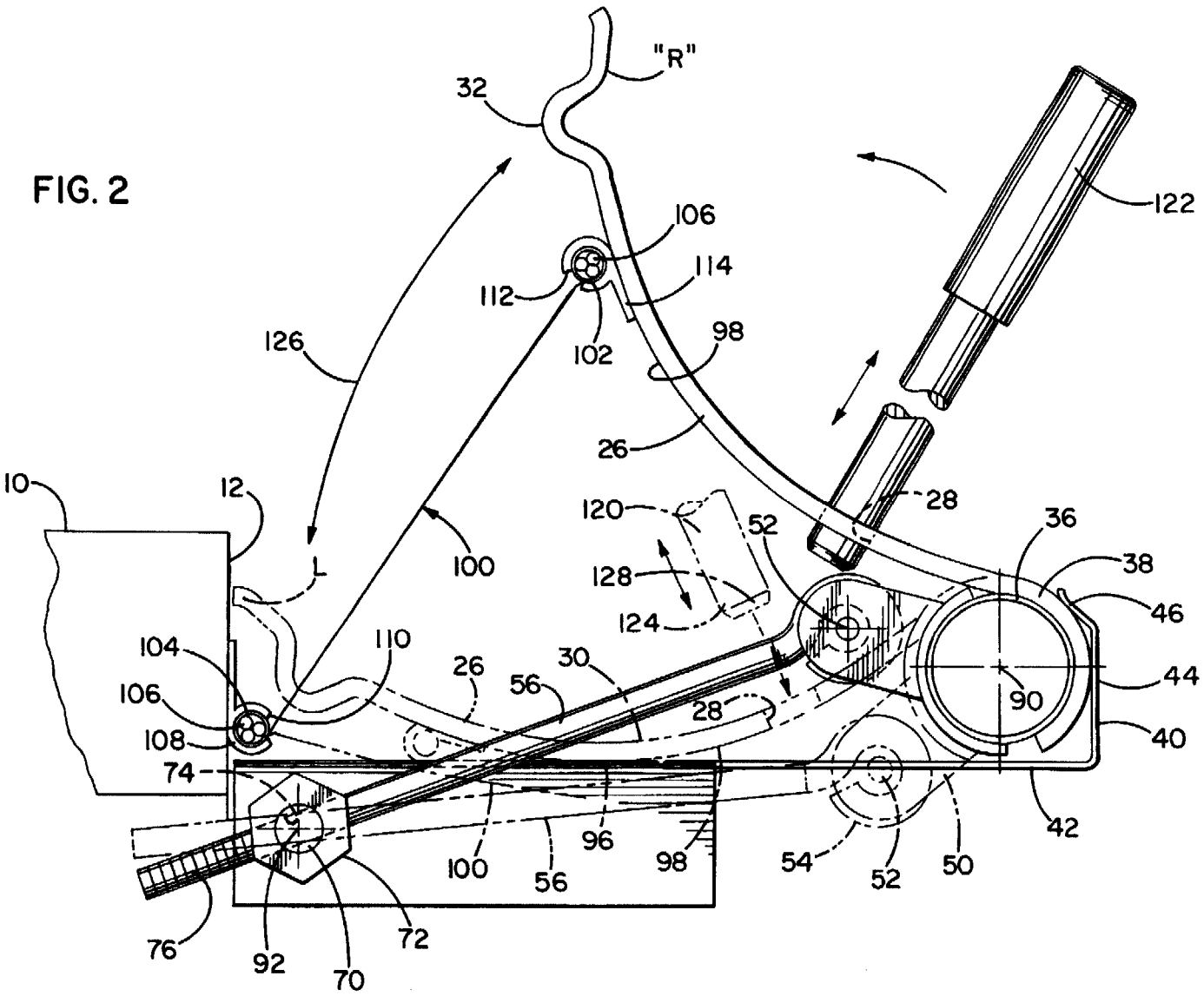
FIG. 2 is an enlarged fragmentary vertical section of part of the lane.

As can be seen in FIG. 2, the gutter section 26 is movable between a lowered positions "L" and a raised position "R". In the lowered position "L", the gutter section 26 has an upwardly facing, concave surface 30. The concave surface 30 is that of a conventional gutter and will be operative to receive any ball leaving the side 12 of the lane bed 10 and conveying the same to the pit area (not shown) of the lane bed 10.

FIG. 2 also illustrates that in the raised position "R" an integral, elongated rail or nose 32 is elevated above the surface of the bed 10 to face the same in proximity to the side 12. The location of the rail 32 in the raised position "R" is such that a conventionally sized ball approaching the edge 12 will engage the rail 32 before the ball begins to drop off the edge 12. Because the gutter 26 is prevented from moving past the raised position "R" as shown in FIG. 2 by means to be described, the ball, upon encountering the rail 32 will be deflected and retained on to the lane bed 10 to continue rolling toward the pin deck 16. To mount the gutter 26 for movement between the raised and lowered positions "R" and "L", an elongated torque tube 36 extending the length of the gutter section 26 is provided. A curved edge 38 of the gutter 26 on the side thereof remote from the rail 32 extends partly about the torque tube 36 and is connected thereto by any suitable means.

A series of mounting brackets 40 spaced 3–4 ft. along the length of the lane bed 10 and each include a channel-like section including a flat bottom 42, an upright section 44 extending therefrom and a redirected section 46 extending from the upright section 44. As a result, the torque tube 36 may nest in the channel like configuration and will actually pivot therein as will be seen as the gutter 26 is moved between its two positions.

Each of the series of the brackets 40 at spaced intervals along the length of the gutter section 26 are provided with a series of holes 48 for threaded fasteners or the like whereby the same may be secured to the foundation for the lane bed 10.

Figure 3:
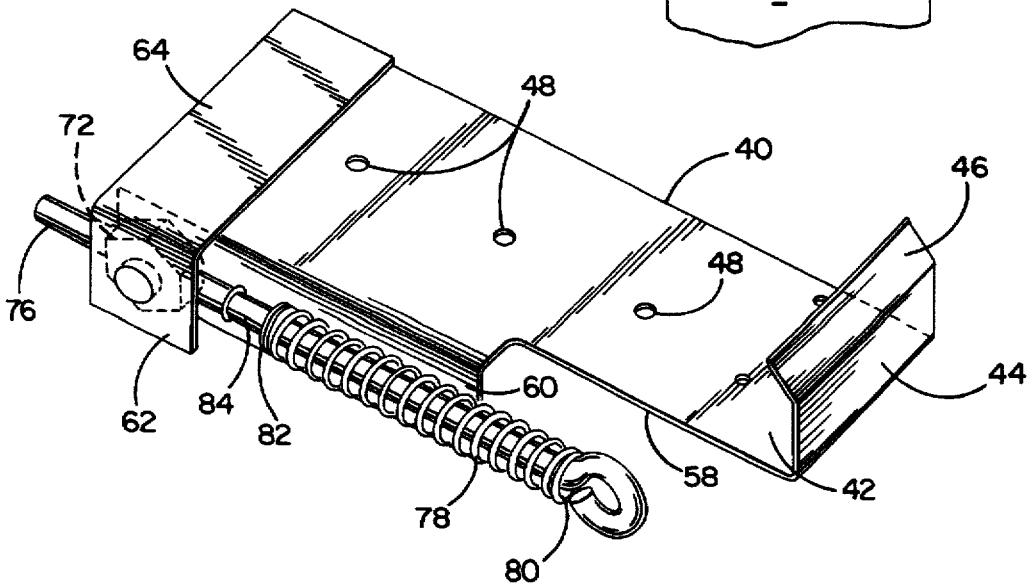
FIG. 3 is a perspective view of a bracket assembly used in the lane.

At each location of one of the brackets 40, just to one side thereof, the torque tube 36 is provided with a lever 50 that faces generally in the direction of the lane bed 10 as seen in FIG. 2. The lever 50 mounts a stud 52 which in turn pivotally mounts an eye 54 on the end of an elongated rod 56. As can be seen in FIG. 3, the bracket 40 includes a relief area 58 along one side thereof whereat the lever 50 may move in adjacency to the bracket 40 without making contact therewith.

Returning to the rod 56, the bracket 40 includes a downturned panel 60 and a spaced, downturned arm 62 of an L-shaped bracket 64 secured to the remainder of the bracket 40 by any suitable means. A stud 70 is mounted for rotation and holes (not numbered) in the panels 60 and 62 about a horizontal axis and mounts a hex nut 72. The stud 70 includes an internal aperture 74 which slidably receives an end 76 of the rod 56. A compression coil spring 78 is impaled by the rod 56 and includes one end 80 abutting the eye 54 and an opposite end 82 abutting a sleeve 84 (FIG. 3 only) which in turn is abutted up against the nut 72. The arrangement is such that the spring 78 will be under compression in either of the positions of the rod 56 (and thus the gutter 26) illustrated in FIG. 2. It will be appreciated that for one of those positions, namely, for the raised position "R" of the gutter section 26, the lever 50 and the stud 52 will be above a line interconnecting the pivot axis 90 of the torque tube 36 and the pivot axis 92 of the stud 70. That, of course, will translate into a clockwise bias of being applied to the torque tube 36 which is to say a bias against the gutter section 26 moving the same toward or maintaining the same in the raised position "R".

Conversely, when the gutter section 26 is in its lowered position "L", the stud 52 will be below the line interconnecting the axis 90 and 92 which will translate into a counter-clockwise biasing of the torque tube 36 which is to say, a bias applied to the gutter 26 towards its lowered position "L".

It is to be particularly noted that the lever arm 50 faces the lane bed 10 and thus the spring 78. Consequently, as the torque tube 36 pivots between the positions illustrated in FIG. 2, each time the stud 52 approaches a line drawn between the axes 90 and 92, the compression on the spring 78 will be increased as the rod 56 moves to the left as viewed in FIG. 2. This increase in compressive force will occur until the stud 52 moves just past the line between the axes 90 and 92 at which time the bias will tend to continue movement of the arm 50, and bias and move the gutter section 26 to one or the other of the raised "R" or lowered "L" positions. Consequently, an overcenter mechanism is defined by the arrangement of the spring 78 to the eye bolt 56, the lever arm 50, and the location of the studs 52 and 70 in relation to the axes 90 and 92.

It will also be observed that the arrangement of these elements with respect to the channel defined by the surfaces 42, 44 and 46 is such as to bias the torque tube 36 into the channel defined thereby. As a consequence, there is no need to provide a special journal for the torque tube 36 because the same is held in place within the channel in which it may rotate by the bias of the spring 78.

In combination with stops limiting movement of the gutter section past the raised position "R" or the lowered position "L", the previously described overcenter mechanism acts as a detent for the gutter section 26 in either position. Movement of the gutter section 26 past the lowered position "L" shown in FIG. 2 is prevented by contact at approximately a point 96 (FIG. 2) whereat the undersurface 98 of the gutter section 26 engages the upper surface of the bracket 40.

Movement of the gutter section 26 past the raised position "R" is prevented by a curtain section, generally designated 100, which is generally like that disclosed in the previously identified Conklin et al. patent. Specifically, the curtain 100 is interposed between the side 12 of the lane bed 10 and the undersurface 98 of the gutter section 26. The curtain 100 may be formed of fabric or any flexible material such as plastic. At its sides, it includes loops 102 and 104 which, in turn, are formed into and maintained in a generally circular shape by interior rope-like cords 106.

A C-shaped channel 108 is mounted to the side 12 of the bed 10 at a location below the gutter section 12 when in its lowered position "L" and the same receives the loop 100. The remainder of the curtain extends out of the channel 108 through the opening 110 therein to enter the opening 112 in a similar C-shaped channel 114 secured to the undersurface 98 of the gutter section 28 just below the rail 32. The loop 102 is contained within the channel 114, thereby securing the curtain 100 between the side 12 and the gutter section 26.

When the gutter section 26 is in the raised position "R", the curtain 100 will be taut as illustrated in FIG. 2, and thus prevent further clockwise rotation of the gutter section 26 past the raised position illustrated.

At the same time, if the gutter section 26 is lowered to the lowered position "L", the curtain 100 simply folds and stows beneath the gutter 26.

To move the gutter section 26 between the raised and lowered positions "R" and "L", an elongated tool 120 having a handle 122 at its upper end is provided. As illustrated in FIG. 2, the lower end 124 of the tool 120 may be inserted in the opening 28 in the gutter section 26 and a pivoting force shown schematically by an arrow 126 applied to the handle 122 to move the gutter section 26 between the two positions illustrated. If desired, the end 124 of the tool 120 may have a bevel 128 to simplify insertion of the tool into the opening 28.

After the gutter section 26 has been moved to the desired position, it is only necessary to remove the tool by pulling upward on the handle 122 thereof.

To facilitate manual movement of the gutter section 26 between the previously described position, they are preferably formed of a light weight material such as plastic. For example, so-called ABS (acrylonitrile batyl styrene) plastic may be used.

In some instances, powered movement of the gutter section 26 may be desired. In such cases, the means disclosed in the previously identified Conklin et al. patent may be used.

Preferably, the curtains 100 are indicia bearing, which is to say that they are colored and/or bear designs and/or advertising to thereby be attractive and/or a source of advertising revenue for the proprietor of the bowling house in which the lane is installed.

Figure 4:
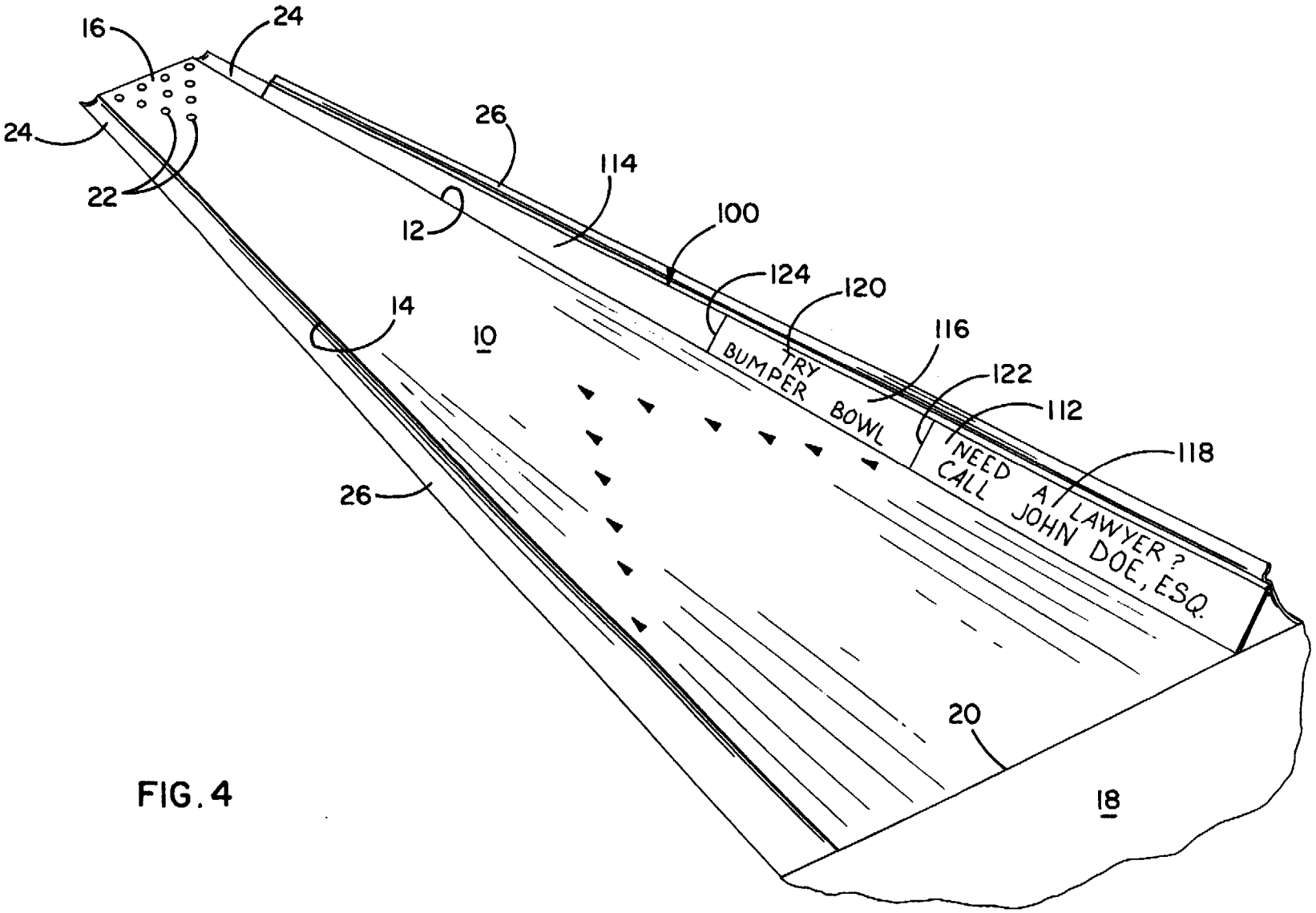
FIG. 4 is a perspective view of the lane partially converted for use as a carom bowling lane or for instruction purposes.

With reference to FIG. 4, this is facilitated by making each of the curtains 100 at least two panels. One panel, 112, is a relatively short panel and is located immediately adjacent the approach end 18 of the bowling lane. Another curtain panel 114 is relatively long in length compared to the panel 112 and extends from the panel 112 to the pin deck 16.

In some instances, one or possibly two additional, relatively short panels, such as the short panel 116, are also employed and located adjacent the approach end 18. Each of the short panels 112 and 116 include indicia 118 and 120 respectively. Thus, the short panel 112 may contain an advertising indicia such as "Need A Lawyer? Call John Doe, Esq.".

A different advertising statement (or the same advertising statement if desired) can be employed on the short panel 120. Thus, as seen in FIG. 4, the short panel 120 contains the advertising message "Try Bumper Bowl".

The panels 112 and 120 are obtained simply by severing a full length one of the curtains 100 across its length as at lines 122 and 124. Depending upon the nature of the material employed in forming the curtains 100, additional steps such as stitching, heat sealing, etc. may be utilized to prevent the ends of the panels 112, 114 and 120 from unraveling at the respective junctions.

Because of the nature of the loop receiving channels 108 and 114, the panels 112 and 120 may be easily and readily removed from the end of the lane 10 adjacent the approach 18 without removing the vast majority of the curtain 100 represented by the relatively long panel 114.

In this respect, the length of each of the panels 112 and 120 is intended to be considerably less than half the length of the bowling lane 100 which, not including the approach, will be sixty feet in the usual case. Not untypically, the length of the short panels 112 and 120 will each be approximately twelve feet with the preferred embodiment utilizing a length of 136 inches.

While more than two of the short panels may be employed, generally speaking, no more than two will be used because additional panels will be increasingly remote from the area of the lane occupied by the bowlers, namely, the approach 18 and thus less visible reducing their viability as an effective advertising medium.

It will be readily appreciated that a bowling lane proprietor need only maintain an inventory of blank relatively short panels such as the panels 112 and 120. He may then solicit advertising locally or otherwise and have the advertising message inscribed on such a blank panel and then located in place between the lane and the underside of the gutter 26. Through the use of relatively short panels, it is easy to employ more than one advertising message per gutter as is illustrated in FIG. 4 and, when necessary, change only a desired one of the several messages. Furthermore, the use of individual panels eliminates any need to remove the entire curtain from the lane to substantially simplify installation and removal of the advertising messages.

Further as a consequence of the foregoing, it will be readily appreciated that an extremely simple convertible lane structure is provided by the invention. The ability to manually convert the lane from one configuration to the other through the simple use of the tool 120 allows for a rapid conversion process so that the game is not slowed down. By suitably selecting the pre-load on the spring 78, a desired assisting force will aid in raising the gutter section 26 to its raised position "R", once the stud 52 has moved over center and the use of the spring bias to maintain the torque tube 36 within a channel like configuration eliminates any need for special journals or the like. As a consequence, the convertible bowling lane of the present invention is ideally suited for use by novice bowlers, either bowling by themselves, or receiving instruction or even bowling with more experienced bowlers because of the ready convertibility of the structure.

We claim:

1. In the method of making a convertible bowling lane including at least one movably mounted gutter extending along a side of a bowling lane bed from the approach toward the pin deck thereof and mounting a ball deflecting rail along said side for movement between a first position wherein a ball moving toward said side will engage said rail before leaving the bed, and a second position wherein a ball moving toward said side may leave the bed to enter the gutter, and a curtain installed to extend between said side and said gutter and to be exposed when said rail is in said first position and covered by said gutter when said rail is in said second position, the steps of:

making the curtain in at least two sections including at least one section have a relatively short length to provide means defining an easily removable section adjacent said approach; a separate section having a relatively long length remote from said approach; and placing indicia on the short section or sections to be exposed to the user or users of the lane wherein said rail is in said first position.

2. The method of claim 1 wherein said indicia is advertising so that said short section or sections is used as a readily changeable advertising medium.

3. A curtain for use in a convertible bowling lane to be disposed between the side of a lane bed and the underside of a movable gutter, said curtain comprising:

at least two curtain panels of flexible material, one of said panels being relatively short relative to the other;

loops on opposed sides of both said curtain panels;

means within said loops to form and maintain the loops in a generally circular shape; and indicia on said relatively short curtain panel.

4. The curtain of claim 3 wherein said indicia is advertising indicia.

5. A curtain for use in a convertible bowling lane to be disposed between the side of a lane bed and the underside of a movable gutter, said curtain comprising:

at least two curtain panels of flexible material, one of said panels being relatively short in relation to the other;

generally circular loops at the sides of said curtain panels; and advertising indicia on said relatively short curtain panel.

6. A curtain for use in a convertible bowling lane to be removably disposed between the side of a lane bed and the underside of a movable gutter at a location closely adjacent the approach of the bowling lane, said curtain comprising:

a relatively short curtain panel of flexible material having a length considerably less than half the length of the bowling lane;

generally circular loops at the sides of said curtain panel; and indicia on said curtain panel.

7. A convertible bowling lane including:

at least one movably mounted gutter extending along a side of a bowling lane bed from the approach to the pin deck of the lane and mounting a ball deflecting rail along said side for movement between a first position wherein a ball moving toward said side will engage said rail before leaving the bed, and a second position wherein a ball moving toward said side may leave the bed to enter the gutter;

a curtain installed to extend between said side and said gutter and to be exposed when said rail is in said first position and covered by said gutter when said rail is in said second position, said curtain being defined by at least one relatively short panel adjacent said approach and a separate, relatively long panel extending from the relatively short panel to the pin deck; and indicia on said relatively short panel.

8. The convertible bowling lane of claim 7 wherein said indicia is advertising so that said relatively short curtain panel is used as an advertising medium.

9. The convertible bowling lane of claim 7 wherein said relatively short panel may be removed from said bowling lane independent of said relatively long panel.

10. A convertible bowling lane comprising:

a bowling lane bed having a pin deck at one end and an approach adjacent the opposite end;

at least one gutter extending along a side of said bed and including ball catching means and ball deflecting means;

means movably mounting said gutter for movement between a ball catching position for catching a ball leaving the bed along said side and a ball deflecting position for deflecting a ball approaching said side, said movable mounting means including a torque tube mounting said gutter, generally along an edge thereof for pivotal movement between said positions about an axis, a lever being fastened to said torque tube and a plurality of channels along said edge, said torque tube being nested in said channels for pivotal movement therein, and means for biasing said torque tube into said channels;

manual means for moving said gutter between said position;

detent means for holding said gutter of either of said positions, said detent means being an overcenter mechanism including a pair of stops, one for limiting movement of said gutter past said ball catching position and another for limiting movement of said gutter past the ball deflecting position, a compression coil spring interconnected between said gutter and a stationary object for biasing said gutter and arranged to exert a lesser bias on said gutter when said gutter is in either of said positions and a greater bias on said gutter when said gutter is between said positions; and a curtain extending between said side and said gutter for limiting movement of said gutter past said ball deflecting position, said curtain comprising at least two curtain panels, including a relatively short curtain panel adjacent said approach and a relatively long curtain panel extending from said short curtain panel to said pin deck; and advertising indicia on said relatively short curtain panel.

* * * * *